US006142756A

United States Patent [19]

Hashimoto et al.

[11] Patent Number: 6,142,756

[45] Date of Patent: Nov. 7, 2000

[54] ROTARY COMPRESSOR

[75] Inventors: Takeshi Hashimoto; Mototaka Esumi; Osamu Aiba; Mitsuru Kurimoto, all of Shiba, Japan

[73] Assignee: Matsushita Electric Industrial Co., Ltd., Osaka, Japan

[21] Appl. No.: 09/310,577

[22] Filed: May 12, 1999

[30] Foreign Application Priority Data

Jun. 9, 1998 [JP] Japan ..... 10-160122

[51] Int. Cl.[7] ..... F03C 2/00

[52] U.S. Cl. ..... 418/63; 418/179; 418/152

[58] Field of Search ..... 418/63, 179, 152

[56] References Cited

U.S. PATENT DOCUMENTS 5,346,248 9/1994 Nakashima et al. ..... 418/178

FOREIGN PATENT DOCUMENTS 8-284825 4/1995 Japan ..... 418/153
10-281088 2/1996 Japan ..... 418/153
8-049048 2/1996 Japan ..... 418/153
9-250477 2/1996 Japan ..... 418/153
9-112464 5/1997 Japan ..... 418/153

*Primary Examiner*—Thomas Denion
*Assistant Examiner*—Theresa Trieu
*Attorney, Agent, or Firm*—Wenderoth, Lind & Ponack, L.L.P.

[57] ABSTRACT

A vane of a compressor is made of solid phase sintering material of which a sintering density is not less than 7.2g/cm$^3$ and a hollow rate is not more than 10%, and to which CrN phase is adhered through a PVD process. A roller of the compressor is made of hardened and tempered material having a hardness equal to cast iron FC300 (specified by JIS). The roller may be made of hardened and tempered material including at least one of Ni, Cr and Mo, and having a hardness equal to cast iron FC300. The vane and roller are combined, so that a sliding section having excellent abrasion-resistance can be constructed. As a result, a rotary compressor, which employs R134a or R22 coolant as well as HFC system or HC system coolant both of which are R22 substitutes, having extremely high reliability can be realized.

18 Claims, 2 Drawing Sheets

ROTARY COMPRESSOR

FIELD OF THE INVENTION

The present invention relates to a rotary compressor employed in e.g. an air-conditioner, and more particularly relates to a compressor that uses R22 and R134a, as well as HFC and HC systems coolant that are R22 substitutes.

BACKGROUND OF THE INVENTION

A conventional rotary compressor employed in an air-conditioner comprises a cylinder, a roller eccentrically revolvable within the cylinder, and a vane inserted in a travelable manner into a through hole formed in a radial direction of the cylinder and slidable with regard to the roller. In general, the vane is made of a special iron system material having excellent abrasion-resistance and which has undergone heat treatment.

In recent years, the vane, roller and cylinder have been required to meet more severe sliding conditions, and the coolant has been replaced with R22 substitutes to prevent the ozone layer from being destroyed. Under these circumstances, elements with excellent abrasion-resistance are desirably used. The vane has been made of special steel including SKH51 (specified by Japanese Industrial Standard, hereinafter referred to as JIS), special casting, or sintered iron system material; however, these respective materials cannot satisfy the more severe conditions from a standpoint of abrasion-resistance.

SUMMARY OF THE INVENTION

The present invention addresses the problem discussed above and aims to provide a rotary compressor having better abrasion-resistance.

The rotary compressor of the present invention comprises the following elements:

(a) a cylinder;

(b) a roller eccentrically revolvable within the cylinder;

(c) a vane inserted in a travelable manner into a through hole formed in a radial direction of the cylinder, and slidable with regard to the roller.

The vane is specified as follows: sintering density $\geqq 7.2$ g/cm$^3$, hollow rate $\leqq 10\%$, forming solid phase sintering, and adhered by CrN phase through a PVD process.

The roller is made of hardened and tempered material having a hardness corresponding to cast iron FC300 specified by JIS.

The roller is preferably made of hardened and tempered material including at least one of Ni, Cr, and Mo, and having a hardness corresponding to cast iron FC300 specified by JIS.

The structure discussed above can realize the rotary compressor having excellent abrasion-resistance and high reliability.

DETAILED DESCRIPTION OF THE INVENTION

An exemplary embodiment of the present invention is described hereinafter with reference to the accompanying drawings.

Figure 1:
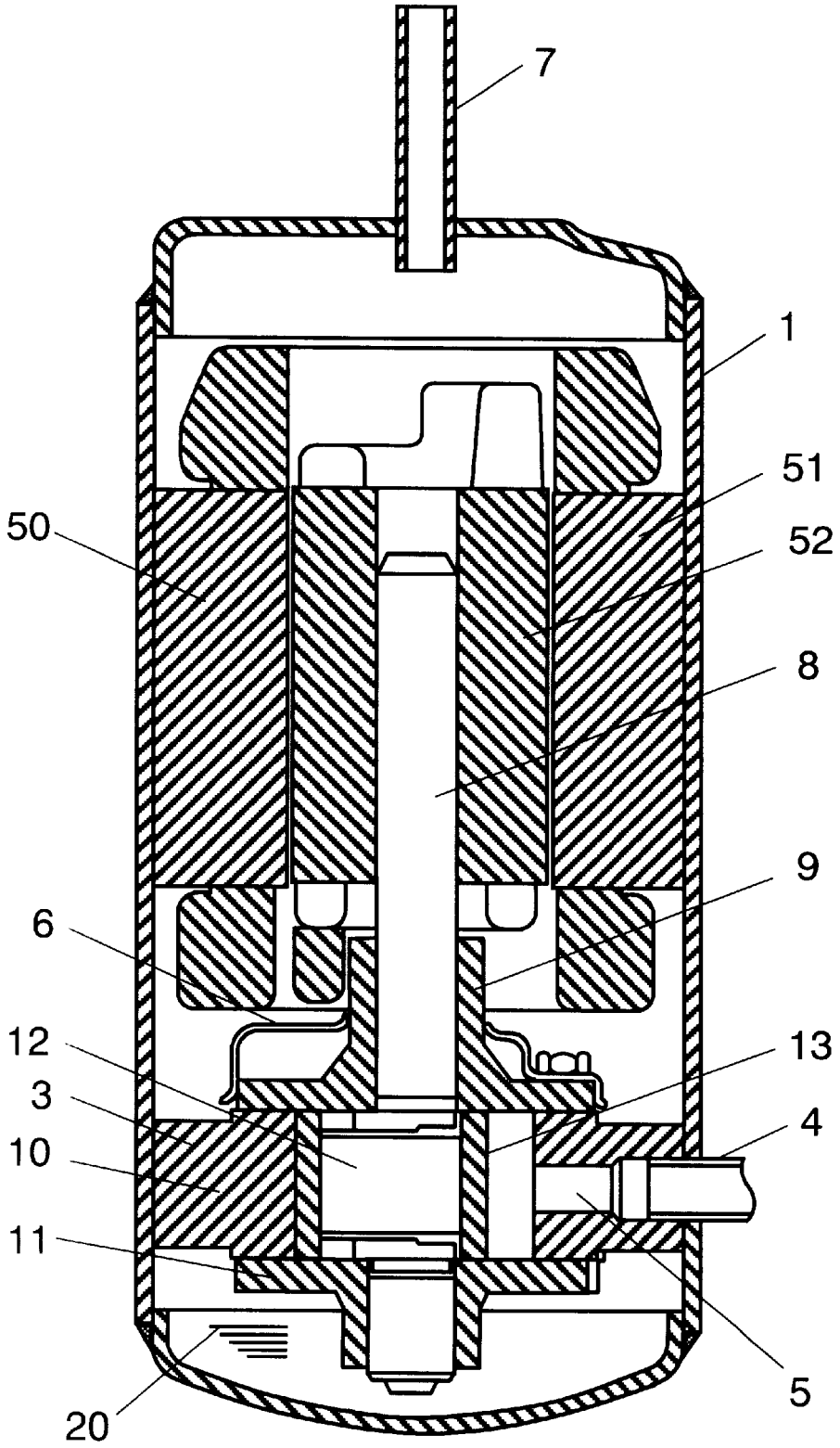
FIG. 1 is a vertical cross section of a rotary compressor in accordance with an exemplary embodiment of the present invention.
Figure 2:
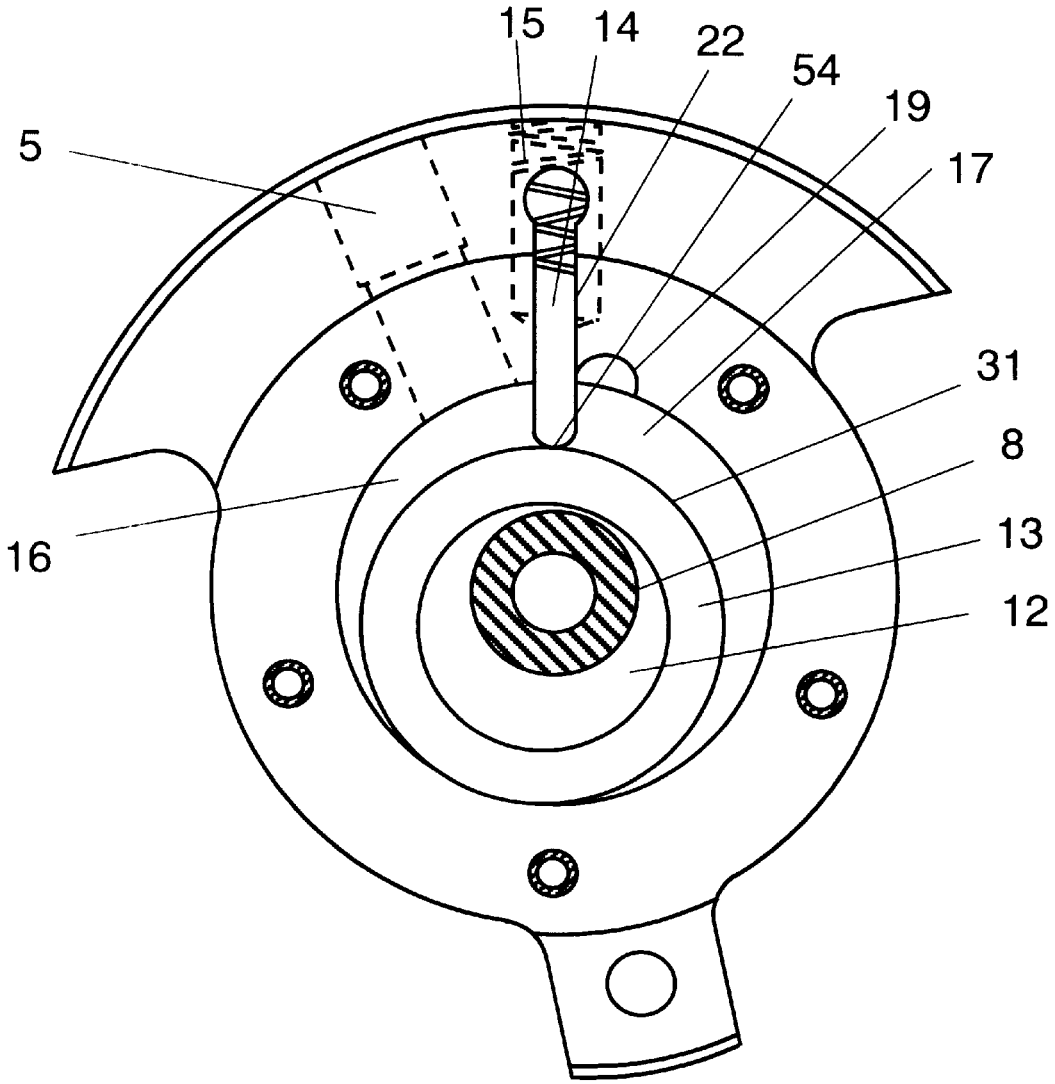
FIG. 2 is a horizontal cross section of an essential part of the rotary compressor in accordance with the exemplary embodiment of the present invention.

FIG. 1 is a vertical cross section of the rotary compressor in accordance with an exemplary embodiment of the present invention, and FIG. 2 is a horizontal cross section of an essential part of the same rotary compressor.

A gas-tight enclosure 1 includes motor section 50 and compression mechanism 3 therein. Motor section 50 comprises stator 51 around which wires are wound and rotor 52 facing stator 51 via an annular space in-between. Shaft 8 fixed to rotor 52 is journaled by main bearing 9 and sub-bearing 11.

In a cylinder 10, roller 13 through which shaft 8 is extended is disposed having an eccentric section 12. Powering the wound wires of stator 51 rotates rotor 52, and then roller 13 revolves around shaft 8 within cylinder 10.

Vane 14 inserted into through hole 22 of cylinder 10 is urged toward roller 13 by spring 15 and discharged-pressure (back pressure) so that vane 14 separates the inside of cylinder 10 into a suction room and a compression room. Cylinder 10 is provided with suction hole 5 that connects with an accumulator (not shown) via suction tube 4.

In a bottom section of gas-tight enclosure 1, refrigeration oil 20 functioning as lubricant is pooled. When coolant is HFC system, ester oil is recommended as refrigeration oil. When coolant is HC system, mineral oil is recommended as refrigeration oil.

An operation of the structure discussed above is described hereinafter.

Motor section 50 drives shaft 8, which revolves roller 13 counterclockwise as a planet as shown in FIG. 2. Then, coolant gas, e.g. HFC system coolant, is inhaled from suction tube 4 through suction hole 5 into suction room 16. On the other hand, the coolant gas compressed in the compression room 17 is discharged inside of gas-tight enclosure 1 through discharging hole 6 via discharging notch 19. At this moment, tip section 54 of vane 14, which partitions suction room 16 and compression room 17, is urged against outer wall 31 of roller 13 by spring 15 and the pressure applied to the back of vane 14. The revolving of roller 13 results in sliding of tip section 54 with regard to outer wall 31.

This sliding section is lubricated mainly by the oil mixed in the coolant gas. The coolant gas entered through suction tube 4 slightly includes refrigeration oil which circulates through a coolant cycle mechanism. However, the amount of oil 20 contained in the coolant gas is as little as to make the sliding section a critical sliding condition close to metal-to-metal contact. When HFC or HC system coolant, among others, is used, the sliding condition becomes further severe because these coolants have little lubricating ability.

In this exemplary embodiment, vane 14 is made of solid-phase-sintering-iron of which sintering density is not less than 7.2 g/cm$^3$ and hollow rate is not more than 10%. CrN phase is adhered to this material by a PVD process. The PVD process means physical vapor deposition, which is a method of heating and vaporizing thin-film-forming-material in vacuum environment to form a thin film on a base material. This method employs resistance heating, high-frequency heating, electron beam heating, or laser heating. It also includes sputtering by ion-beam.

In the PVD process, evacuation is practiced; however, when the base material has a lot of hollows, it takes a long time to evacuate air from the hollows, or leftover-air appears gradually. It is thus difficult to produce a substantial vacuum condition. Accordingly, a higher sintering density and a lower hollow rate are demanded to realize the evacuation. Liquid phase sintering material can contribute to raise the sintering density; however, liquid phase sintering material produces a poor dimensional accuracy when sintered, thereby incurring additional process in a costs. Therefore, the solid phase sintering material having undergone the PVD process would produce advantages both of dimensional accuracy and cost. However, the evacuation problem discussed above has deadlocked the solid phase sintering material from undergoing the PVD process.

In this exemplary embodiment, the evacuation can be realized with ease under the condition of a sintering density $\geqq 7.2$ g/cm$^3$, and a hollow rate $\leqq 10\%$. The solid phase sintering material thus can undergo the PVD process. The condition out of the above figures would make the evacuation difficult because of too many hollows.

When the compressor operates, vane 14 being urged by back-pressure and spring 15 travels back and forth in through hole 22 of cylinder 10. This reciprocation hardly produces an oil film between hole 22 and a side-wall of vane 14, whereby a very severe sliding condition is produced. The sliding section between outer wall 31 of roller 13 and tip section 54 of vane 14 encounters a critical sliding condition with little oil and close to metal-to-metal contact, which is a much more severe condition.

In this exemplary embodiment, vane 14 is adhered by CrN phase having 2–10 $\mu$m thickness through PVD processing, and roller 13 is made of hardened and tempered material having a hardness corresponding to cast iron FC300 specified by JIS. Vane 14 and roller 13 thus structured are combined so that tip section 54 is substantially less worn due to sliding with regard to roller 13 under severe conditions. As a result, a highly reliable compressor is realized. Regarding roller 13, since it has a hardness equal to cast iron FC300 specified by JIS, it is hardly worn away due to the sliding with regard to tip section 54 of vane 14.

The hardened and tempered material of roller 13 may include at least one of Ni, Cr, or Mo. For instance, if the steel including these components is employed, the desirable hardness equal to cast iron FC300 can be obtained with ease.

Vane 14 can use SKH51 as sintering powder material. In this case, a hardness of the base material becomes higher, and a breakaway-resistance of CrN phase having undergone the PVD process is increased. As a result, a more highly reliable compressor can be realized.

The solid sintering material can be provided with a sealing hollow process. This process would increase the amount of vacuum by the evacuation in the PVD process, and also increases the breakaway-resistance of CrN phase. These improvements reduce the wearing-away of tip section 54 of vane 14 even under the severe sliding condition with regard to roller 13, and contribute to realizing the more reliable compressor.

CrN phase can be adhered by the PVD process only to tip section 54 of vane 14, which substantially eases the process and reduces the cost.

The rotary compressor of the present invention as discussed above can substantially decrease the wearing-away of the vane, and prove itself highly reliable even when R22 substitute coolant such as HFC system or HC system coolant is used.

What is claimed is:

1. A rotary compressor comprising:

(a) a cylinder;

(b) a roller eccentrically revolvable in said cylinder; and (c) a vane inserted in a travelable manner into a hole formed in a radial direction of said cylinder, and slidable with regard to said roller;

wherein said vane is made of solid phase sintering material, and is adhered by CrN phase through a PVD process, wherein the solid phase sintering has a sintering density $\geqq 7.2$ g/cm$^3$, and a hollow rate $\leqq 10\%$, wherein said roller is made of hardened and tempered material having a hardness corresponding to cast iron FC300 specified by Japanese Industrial Standard.

2. A rotary compressor comprising:

(a) a cylinder;

(b) a roller eccentrically revolvable in said cylinder; and (c) a vane inserted in a travelable manner into a hole formed in a radial direction of said cylinder, and slidable with regard to said roller;

wherein said vane is made of solid phase sintering material, and is adhered by CrN phase through a PVD process, wherein the solid phase sintering has a sintering density $\geqq 7.2$ g/cm$^3$, and a hollow rate $\leqq 10\%$, wherein said roller is made of hardened and tempered material including at least one of Ni, Cr, and Mo, and having a hardness corresponding to cast iron FC300 specified by Japanese Industrial Standard.

3. The rotary compressor as defined in claim 1 wherein said vane comprises sintering powder of SKH51 specified by Japanese Industrial Standard.

4. The rotary compressor as defined in claim 1 wherein said vane comprises solid phase sintering material, and is provided with sealing-hollow-process.

5. The rotary compressor as defined in claim 1 wherein said vane is provided with a PVD process only at a tip section thereof.

6. The rotary compressor as defined in claim 1 wherein HFC system coolant is used, and ester oil is employed as refrigeration oil.

7. The rotary compressor as defined in claim 3 wherein HFC system coolant is used, and ester oil is employed as refrigeration oil.

8. The rotary compressor as defined in claim 4 wherein HFC system coolant is used, and ester oil is employed as refrigeration oil.

9. The rotary compressor as defined in claim 5 wherein HFC system coolant is used, and ester oil is employed as refrigeration oil.

10. The rotary compressor as defined in claim 1 wherein HC system coolant is used, and mineral oil is employed as refrigeration oil.

11. The rotary compressor as defined in claim 3 wherein HC system coolant is used, and mineral oil is employed as refrigeration oil.

12. The rotary compressor as defined in claim 4 wherein HC system coolant is used, and mineral oil is employed as refrigeration oil.

13. The rotary compressor as defined in claim 5 wherein HC system coolant is used, and mineral oil is employed as refrigeration oil.

14. The rotary compressor as defined in claim 2 wherein said vane comprises sintering powder of SKH51 specified by Japanese Industrial Standard.

15. The rotary compressor as defined in claim 2 wherein said vane comprises solid phase sintering material, and is provided with sealing-hollow-process.

16. The rotary compressor as defined in claim 2 wherein said vane is provided with a PVD process only at a tip section thereof.

17. The rotary compressor as defined in claim 2 wherein HFC system coolant is used, and ester oil is employed as refrigeration oil.

18. The rotary compressor as defined in claim 2 wherein HC system coolant is used, and mineral oil is employed as refrigeration oil.

* * * * *